United States Patent [19]

Sack et al.

[11] Patent Number: 4,555,082

[45] Date of Patent: Nov. 26, 1985

[54] SHELF ASSEMBLY AND A SUPPORT BRACKET FOR USE THEREIN

[75] Inventors: Michael C. Sack, 400 E. 71st St., Apt. 5E, New York, N.Y. 10021; Donald E. Henson, Dearborn Heights; Russell M. Sack, Sterling Heights, both of Mich.

[73] Assignee: Michael C. Sack, New York, N.Y.

[21] Appl. No.: 612,476

[22] Filed: May 21, 1984

[51] Int. Cl.[4] ..... A47B 5/00

[52] U.S. Cl. ..... 248/220.1; 248/247; 248/250; 108/42

[58] Field of Search ..... 248/220.1, 240.3, 241, 248/242, 247, 248, 250; 108/115, 59, 42; 312/238; 403/341, 393, 397; 24/573, 518, 542–543

[56] References Cited

U.S. PATENT DOCUMENTS

| | | | |
|---|---|---|---|
| 150,230 | 4/1874 | Dobbs et al. . | |
| 560,884 | 5/1896 | Anderson | 248/250 |
| 682,192 | 10/1901 | Hazen . | |
| 814,811 | 3/1906 | Speed . | |
| 1,056,530 | 3/1913 | Freirich | 248/220.1 |
| 1,159,813 | 11/1915 | Volkardt . | |
| 1,169,056 | 1/1916 | Schweppenheiser | 312/238 |
| 1,173,998 | 2/1916 | Depew | 403/397 |
| 1,286,588 | 12/1918 | Goodykoontz . | |
| 1,325,143 | 12/1919 | Conterio . | |
| 1,599,654 | 9/1926 | Cranston . | |
| 1,985,582 | 12/1934 | Schwinger | 403/393 |
| 2,096,024 | 10/1937 | Anderson | 248/220.1 |
| 2,187,579 | 1/1940 | Von Knopke | 24/542 |
| 2,389,349 | 11/1945 | Eastman . | |
| 3,692,265 | 9/1972 | Barriger . | |
| 3,718,101 | 2/1973 | Sacks . | |
| 3,752,088 | 8/1973 | Kapnek . | |
| 3,783,931 | 1/1974 | Assael . | |
| 4,381,715 | 5/1983 | Forman . | |

FOREIGN PATENT DOCUMENTS

| | | | |
|---|---|---|---|
| 966362 | 10/1950 | France | 24/573 |
| 173005 | 12/1921 | United Kingdom | 248/241 |
| 1495541 | 12/1977 | United Kingdom | 248/241 |

*Primary Examiner*—J. Franklin Foss
*Assistant Examiner*—Robert A. Olson
*Attorney, Agent, or Firm*—Pennie & Edmonds

[57] ABSTRACT

An integral shelf support bracket and a shelf assembly. The support bracket comprises left and right wings, a hinge, and left and right brace members. The wings are connected together by the hinge and extend forward therefrom. The brace members are integrally connected to the wings and extend inward therefrom. The brace members include serrated sections to hold the brace members together, with the wings in pressure engagement with a pair of walls. The shelf assembly includes this support bracket, a bracket lock and an outside sleeve. The bracket lock permanently connects the brace members together, and the outside sleeve mounts on the support bracket and substantially encloses the spaced bounded thereby.

13 Claims, 10 Drawing Figures

FIG. 1
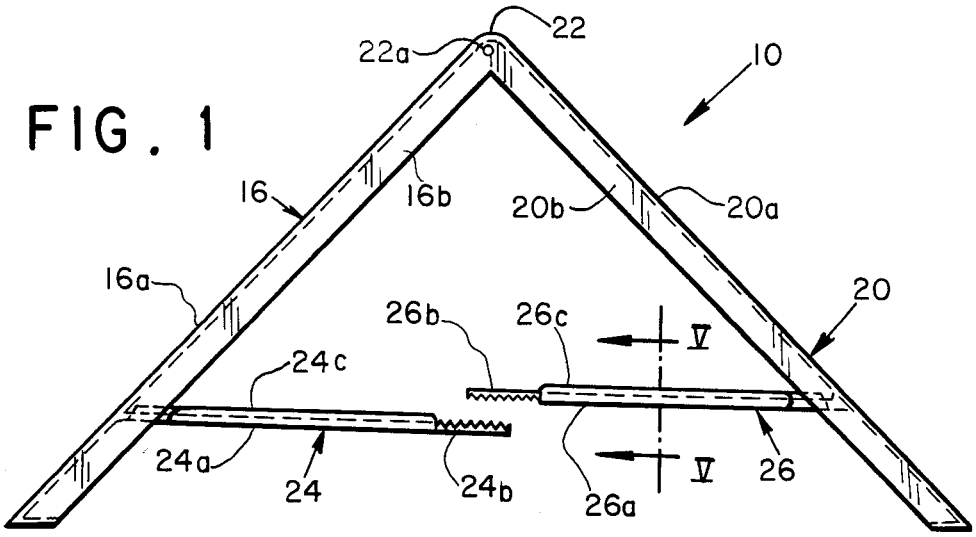
FIG. 2
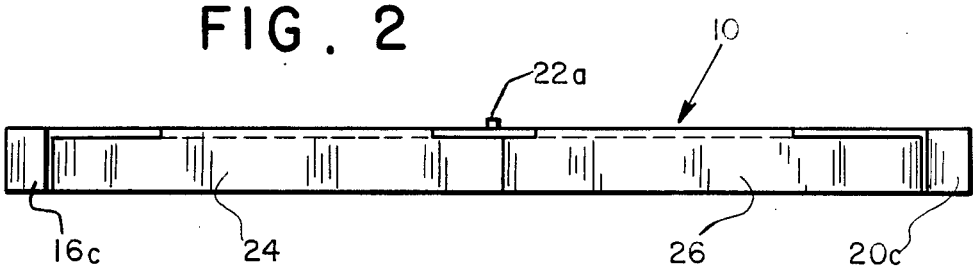
FIG. 3
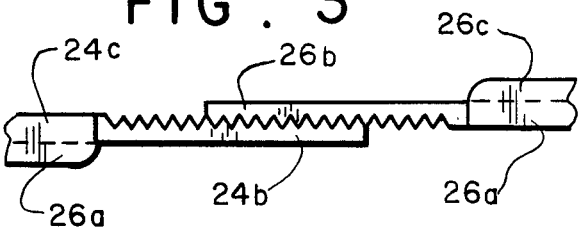
FIG. 4
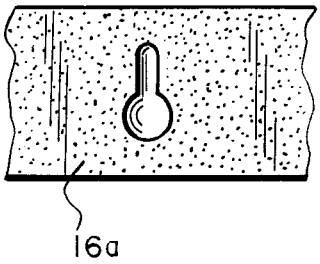
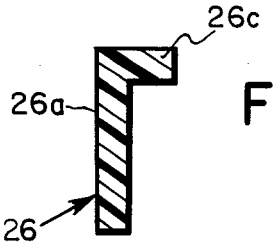
FIG. 5

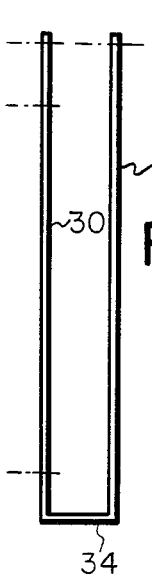
FIG. 8
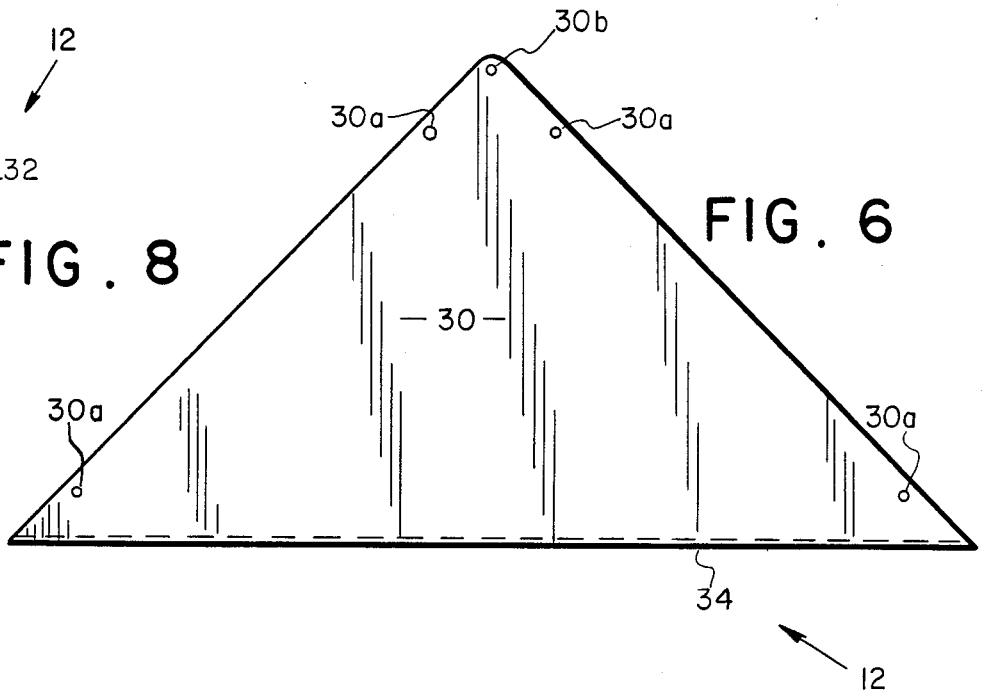
FIG. 6
FIG. 7
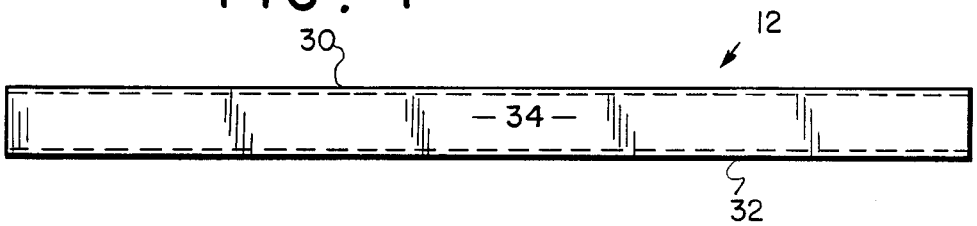
FIG. 9
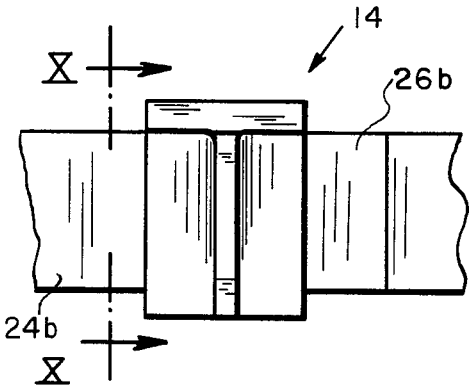
FIG. 10
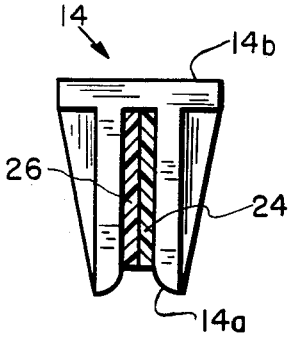

SHELF ASSEMBLY AND A SUPPORT BRACKET FOR USE THEREIN

BACKGROUND OF THE INVENTION

This invention generally relates to shelves and to shelf brackets, and more particularly to shelves and to shelf brackets that are secured in a corner of a room or closet.

One type of corner shelf support bracket comprises a pair of wings or legs that are flexibly or pivotally connected together at one end and which is installed in a corner by bringing those wings or legs into a tight pressure fit against the walls or surfaces forming that corner. Brackets of this type are illustrated in U.S. Pat. Nos. 1,325,143; 1,286,588; 1,159,813; and 682,192. U.S. Pat. No. 814,811 discloses a very similar bracket except that the adjacent ends of the legs or wings of that bracket are not mechanically directly linked together.

One disadvantage of the brackets shown in the listed references is that the brackets comprise a multitude of metal or wood pieces that are individually formed and later connected together. Forming and then joining together these multitude of pieces is time consuming and expensive. Another disadvantage of these brackets is that they may be exposed in use, producing an unappealing appearance, especially if they are located near or above eye-level.

SUMMARY OF THE INVENTION

The present invention relates to an integral corner shelf support bracket and to a shelf assembly employing that support bracket. The bracket comprises left and right wings, a hinge portion, and left and right cross-brace members. The left and right wings each have means for connecting the wings to first and second walls respectively. The hinge portion of the bracket integrally connects those wings together and permits relative flexing movement of the wings in a plane extending between them. The left cross-brace member is integrally connected to the left wing and extends therefrom toward the right wing, and the right cross brace member is integrally connected to the right wing and extends therefrom toward the left wing.

Both of these cross brace members are flexibly moveable in the plane extending between the wings of the bracket. The left and right cross brace members include first and second serrated sections respectively. These serrated sections overlap each other and are provided to hold the cross brace members together with the wings of the bracket in tight pressure engagement with the above-mentioned first and second walls. In particular, these cross brace members may be used to force the left and right wings into a tight pressure engagement with those walls, and then the serrated sections of the cross brace members may be pressed together in a cooperative engaging relationship to hold the wings temporarily in that pressure engagement while the cross brace members are permanently connected together.

This shelf support bracket is very simple to install. Also, because the wings of the bracket are forced into a tight pressure engagement along substantially their entire length with a pair of walls that form a corner, the bracket will support a much heavier load then will one which is brought into pressure engagement with those walls in only small, localized areas. Moreover, the above-described support bracket may be manufactured by an injection molding process—a process that is both very simple and inexpensive.

The shelf assembly of this invention includes the above-described support bracket in combination with, first, a bracket lock, which connects the left and right cross brace members permanently together, and second, an outside sleeve member adapted to be mounted on the support bracket and to substantially enclose the space bounded by the left and right wings thereof and by an imaginary perimeter or surface bridging across the front, unconnected ends of the wings.

By enclosing this space, the sleeve member covers all the interior members or sections of the support bracket as well as most, if not substantially all, of the wings of the bracket, producing a very neat and appealing appearance. The sleeve member is very easy to install and can be done so by simply sliding the sleeve member over and onto the support bracket. In addition, the sleeve member also may be made quickly and inexpensively by means of an injection molding process.

BRIEF DESCRIPTION OF THE DRAWINGS

FIGS. 1 and 2 are top and front views respectively of a shelf support bracket in accordance with this invention.

FIG. 3 is an enlarged view of a portion of the bracket shown in FIG. 1, illustrating the serrated sections of the bracket in greater detail.

FIG. 4 is a side view of a portion of an outside surface of a wing of the support bracket.

FIG. 5 is a sectional view through a cross brace member of the bracket, taken along line V—V of FIG. 1.

FIGS. 6, 7 and 8 are top, front and side views respectively of an outside sleeve member according to the present invention.

FIG. 9 is a front view showing portions of the cross brace members of the shelf support bracket, and also showing a bracket locking cap permanently connecting those cross brace members together.

FIG. 10 is a side view taken along line X—X of FIG. 9 illustrating details of the bracket locking cap shown therein.

DETAILED DESCRIPTION OF THE PREFERRED EMBODIMENTS

The shelf assembly of the present invention is designed to be installed in a corner of a room or closet, between and against a pair of walls that form that corner. This shelf assembly generally comprises support bracket 10, shown in detail in FIGS. 1 through 5, outside sleeve member 12, shown in detail in FIGS. 6, 7 and 8, and locking cap 14, shown in detail in FIGS. 9 and 10. More specifically, support bracket 10 comprises left and right wings 16 and 20, hinge portion 22, and left and right cross brace members 24 and 26. Wings 16 and 20 include side portions **16*a* and 20*a*, top portions 16*b* and 20*b*, and fillet portions 16*c* and 20*c*; and the cross brace members 24 and 26 include main sections 24*a* and 26*a*, serrated sections 24*b* and 26*b*, and reinforcing ribs 24*c* and 26*c*. Sleeve member 12 comprises top wall 30, bottom wall 32, and front wall 34. With the preferred embodiment of the shelf assembly described herein in detail, each of support bracket 10, sleeve member 12, and cap 14** is a one piece, relatively rigid plastic unit formed by means of an injection molding process.

Side portions **16*a* and 20*a* of wings 16, 20 have flat rectangular shapes and, in use, are positioned directly against and parallel with first and second walls respectively. As shown in FIG. 4, at least a section of the outside surfaces of each side portion 16***a* and 20*a*—that is, the surfaces thereof that directly face and contact the above-mentioned walls—has an abrasive texture to increase the friction and thereby enhance the pressure engagement between wings 16 and 20 and those walls, and preferably, this abrasive texture extends over the entire outside surfaces of these side portions. Top portions 16*b* and 20*b* of the wings extend inward—toward the center of support bracket 10 as viewed in FIGS. 1 and 2—from top edges of side portions 16*a* and 20*a*. In assembly, top portions 16*b* and 20*b* of wings 16 and 20 directly support sleeve member 12, specifically top wall 30 thereof. Fillet portions 16*c* and 20*c* of wings 16 and 20 extend inward from front edges of side portions 16*a* and 20*a* thereof and downward from front edges of top portions 16*b* and 20*b* of the wings. Fillet portions 16*c* and 20*c* are provided to cover lateral space, if any, between side portion 16*a* and 20*a* of the wings and front wall 34 of sleeve member 12 to ensure that the shelf assembly, as assembled, has a continuous, smooth appealing appearance across the front thereof.

With reference to FIG. 4, each wing 16 and 20, specifically side portion 16*a* and 20*a* thereof, includes at least one opening, and preferably a plurality of such openings, to mount the wings on means such as nails or screws that are partially inserted into the walls against which bracket 10 is installed. These nails or screws may thus be used to hold support bracket 10 in a desired vertical position during installation thereof and to help support that bracket against vertical loads placed thereon during use of the bracket.

Wings 16 and 20, in particular rearward ends thereof, are integrally connected together by hinge portion 22, and the wings extend forward and outward therefrom. The specific embodiment of support bracket 12 illustrated in FIGS. 1 to 4 is intended for use with a pair of walls that form a substantially 90° corner, and consequently wings 16 and 20 extend forward and outward from hinge portion 22 generally perpendicular to each other. Hinge portion 22 permits flexing movement of wings 16 and 20 in a plane extending therebetween, and this, among other things, permits the angle formed by the wings to be varied. As a practical matter, this allows wings 16 and 20 to be located flush against a pair of walls that, either by design or by accident, do not form a perfect right angle.

Of course, the design of support bracket 10 may be modified, without departing from the scope of the present invention, for use with walls that form angles significantly more or less than 90°, by forming wings 16 and 20 and hinge portion 22 so that the normal or unflexed angle between the wings of the support bracket generally matches the angle between those walls. It should be observed also that the back end of hinge portion 22 is rounded so that the hinge portion will fit tightly against both walls of a corner even if those walls meet at a corner that is slightly rounded, or uneven, or is otherwise not a sharp or perfect 90° angle.

Left cross brace member 24 is integrally connected to left wing 16 and extends inward therefrom toward right wing 20, and right cross brace member 26 is integrally connected to right wing 20 and extends inward therefrom toward the left wing. Both cross brace members 24 and 26 are flexibly moveable in the plane extending between left and right wings 16 and 20. More specifically, left cross brace member 24 is integrally connected to side portion 16*a* of left wing 16, generally midway between the longitudinal ends thereof; and right cross brace member 26 is integrally connected to side portion 20*a* of right wing 20, also generally midway between the longitudinal ends thereof. Both brace members 24 and 26 transversely extend slightly more than half way across support bracket 10, toward the opposite wing, and both of these brace members have generally rectangular shapes.

Serrated sections 24*b* and 26*b* of brace members 24 and 26 are located at inward ends thereof respectively. That is, serrated section 24*b* is located at the right end portion of left brace member 24, and serrated section 26*b* is located at the left end portion of right brace member 26. Serrated sections 24*b* and 26*b* of brace members 24 and 26 oppose and overlap each other, and the shape of the teeth of the former section complements the shape of the teeth of the latter section. With this arrangement, serrated sections 24*b* and 26*b* may engage each other to hold brace members 24 and 26 fixed relative to each other in a range of positions.

With particular reference to FIGS. 1, 3 and 5, ribs 24*c* and 26*c* of brace members 24 and 26 are provided to increase the strength thereof, and in particular to increase the pressure that those brace members can apply to wings 16 and 20. Ribs 24*c* and 26*c* extend rearward from top edges of main portions 24*a* and 26*a* of brace members 24 and 26—that is, the portions thereof between the outward ends and the serrated sections of the brace members—generally perpendicular to those main portions. At the same time, ribs 24*c* and 26*c* transversely extend inward from the outward ends of main portions 24*a* and 26*a* of brace members 24 and 26, or from portions adjacent to those ends, to positions close to but spaced from serrated sections 24*c* and 26*c*. Because the inward ends of rib 24*c* and 26*c* are spaced from these serrated sections, those ribs 24*c* and 26*c* do not interfere with inward movement of serrated sections 24*b* and 26*c*—that is, movement of left serrated section 24*b* to the right and movement of right serrated section 26*b* to the left—slightly past each other, which may be necessary if support bracket 10 is used with a pair of walls that form a corner less than 90°.

With particular reference now to FIGS. 6, 7 and 8, top and bottom walls 30 and 32 of outside sleeve member 12 are generally planar and parallel to each other and are shaped to fit snuggly in a corner of a room or closet, in horizontal positions against, or closely adjacent, the walls that form that corner. More specifically, wall members 30 and 32 have generally flat triangular shapes, which are substantially congruent to the triangular shape formed by wings 16 and 20 and hinge portion 22 of support bracket 10 and by an imaginary line extending across the forward, unconnected ends of those wings. The apexes of the triangular shapes of walls 30 and 32 are rounded, allowing those walls to fit within a corner, with the sides of those triangles against the wall that form that corner, even if those walls do not meet at a sharp right angle. The left and right sides of top and bottom walls 30 and 32 are slightly longer than wings 16 and 20 so that, in assembly, those walls extend slightly forward of the forward ends of the wings.

Top wall 30 includes one or more openings 30*a* to receive legs of racks, additional shelves, or similar structures. These other structures, in turn, may be used to hold or organize a wide range of objects and implements such as boxes, bottles, brushes, or similar devices, rendering the shelf assembly of this invention very well suited for many different purposes. Top wall 30 also includes a back opening 30b that is sized and positioned to receive an upwardly extending pin 22a of hinge portion 22. As explained in greater detail below, pin 22a and opening 30b may be used to hold sleeve member 12 in place on support bracket 10.

Front wall 34 of outside sleeve member 12 integrally connects top and bottom walls 30 and 32 together and, at the same time, keeps the front ends of those walls spaced apart. More specifically, front wall 34 extends downward from a front edge of top wall 30, generally perpendicular thereto, and upward from a front edge of bottom wall 32, generally perpendicular thereto also. Laterally, front wall 34 extends from the left side of top and bottom walls 30 and 32 to the right sides thereof. The height of the front wall 34 is substantially equal to the height of wings 16 and 20 of support bracket 10 so that, in use, sleeve member 12 snuggly fits over those wings, with top wall 30 directly resting on the tops of the wings of the support bracket and with bottom wall 32 either in contact with or only slightly spaced from the bottoms of those wings.

To install the shelf assembly of this invention, mounting means (not shown) such as nails or screws are partially inserted into a pair of walls that form a corner. These nails or screws are, first, located slightly below the desired vertical location for the top of the shelf assembly, and second, spaced apart so that they will fit through the openings in side portions 16a and 20a of wings 16 and 20. Then, wings 16 and 20 are placed on those mounting means. Specifically, wings 16 and 20 are positioned adjacent the corner walls, with the above-mentioned mounting means extending through the side openings in the wings and with top surfaces of those openings directly resting on the mounting means.

Next, wings 16 and 20 are forced into a tight pressure fit with the corner walls by pushing left and right cross brace members 24 and 26 outward and clamping serrated sections 24b and 26b together by hand. This temporarily prevents brace members 24 and 26 from moving laterally relative to each other and, hence, temporarily maintains wings 16 and 20 in the pressure contact with the corner walls. Alternately, the spring force of cross brace members 24 and 26 themselves may be used to bring wings 16 and 20 into the desired pressure fit against the corner walls. To do this, wings 16 and 20 are loosely placed on the above-mentioned mounting means with some space between the surface of the wings and the walls. Brace members 24 and 26 are flexed forward and serrated sections 24b and 26b are clamped together to connect the cross brace members together in a stressed, bowed or arcuate shape that seeks to return to a linear unstressed shape. The cross brace members are then allowed to unflex rearwardly toward their linear unflexed position. This forces or wedges wings 16 and 20 outward into a tight pressure fit against the corner walls.

With wings 16 and 20 in a tight pressure fit against the corner walls, cross brace members 24 and 26 are permanently connected together to hold wings 16 and 20 permanently in pressure contact with those corner walls. This can be done in a variety of ways. With reference to FIGS. 9 and 10, preferably locking cap 14 is used to lock the cross brace members together. Cap 14 comprises an axially extending body, with a rectangularly shaped groove 14a extending upward from a bottom of the cap. Groove 14a laterally extends completely through cap 14, and the width of the groove is substantially equal to the total combined width of serrated sections 24b and 26b when those sections are clamped together. To secure cross brace members 24 and 26 together, cap 14 is simply mounted on serrated sections 24b and 26b thereof; and, in particular, groove 14 is slipped onto those serrated sections. Cap 14 thus holds the teeth of serrated sections 24b and 26b in their interlocked engagement, and this engagement prevents cross brace members 24 and 26 from moving laterally relative to each other. Cap 14 itself may be held in place solely by the force of gravity, although preferably the cap is mounted on cross brace members 24 and 26 in a pressure fit therewith to help hold the cap in place. As discussed in greater detail below, sleeve like member 12 itself may be used to lock the cap itself in place.

It should be noted that it is not necessary to the present invention that cap 14 be mounted on serrated sections 24b and 26b of cross brace members 24 and 26. For instance, support bracket 10 may be modified so that one of the cross brace members 24 or 26 includes an additional section extending outward of the serrated section of that cross brace member and that, in assembly, is positioned contiguous to the main portion of the other cross brace member. With such a support bracket, cap 14 may be mounted onto this additional section of the one cross brace member and, simultaneously, onto the main section of the other cross brace member, to prevent the teeth of the cross brace members from moving away from their interlocked engagement.

Once cross brace members 24 and 26 are permanently connected together, sleeve member 12 is slid onto and rearward along support bracket 10 until front wall 34 of the sleeve member is adjacent or engages the front ends of wings 16 and 20 of the support bracket. Specifically, sleeve member 12 is slid rearward until back opening 30b of the sleeve member is directly over retaining pin 22a of hinge portion 22. The back opening 30b is then positioned on retaining pin 22a, holding the outside sleeve member 12 in place relative to support bracket 10. Preferably, it should be observed, the height and diameter of retaining pin 22a are substantially the same as the height and diameter, respectively, of back opening 30b so that when wall 30 is mounted on the retainer pin, that pin substantially completely fills the back opening 30b, forming a smooth coplanar continuation of the top surface of the top wall of the outside sleeve member.

With particular reference to FIG. 10, preferably cap 14 is dimensioned—and specifically, the distance from the top of groove 14a to top surface 14b of the cap is chosen—so that when that cap is mounted on cross brace members 24 and 26 and the top of groove 14a is brought into contact with the top of those cross brace members, top surface 14b of the cap is coplanar with the top surfaces of wings 16 and 20, specifically top portion 16b and 20b thereof. In this way, in assembly cap 14 supports top wall 30 of sleeve member 12 to help maintain that wall planar during use of the shelf assembly. Furthermore, preferably the total height of cap 14 is equal to the preferred distance between top and bottom walls 30 and 32 of sleeve member 12 so that, in assembly, the top wall of the sleeve member rests on the cap and the cap itself rests on the bottom wall of the sleeve member. Cap 14, hence, transmits forces from top wall 30 to bottom wall 32 so that the bottom wall is employed to help support loads placed on the top wall of the outside sleeve member.

While it is apparent that the invention herein disclosed fulfills the objects previously discussed, it will be appreciated that numerous modifications and embodiments of this invention will be evident or may be devised by those skilled in the art, and it is intended that the appended claims cover all such modifications, embodiments, and all equivalents thereof, as fall within the true spirit and scope of the present invention.

What is claimed is:

1. An integrally molded plastic corner shelf support bracket consisting essentially of:

(a) a left wing having at least one means for connection to a first wall;

(b) a right wing having at least one means for connection to a second wall;

(c) a hinge portion integrally connecting the left and right wings together and permitting relative flexing movement of said wings in a plane extending therebetween;

(d) a left cross brace member (i) integrally connected to the left wing and extending therefrom toward the right wing and flexibly moveable in the plane extending between the wings, and (ii) including a first serrated section having a plurality of triangular shaped teeth; and (e) a right cross brace member (i) integrally connected to the right wing and extending therefrom toward the left wing and also flexibly moveable in the plane extending between the wings, and (ii) including a second serrated section having a plurality of triangular shaped teeth overlapping the first serrated section whereby the cross brace members may be flexed in said plane to force the left and right wings into pressure engagement with the first and second walls, and the serrated sections may be pressed together in cooperative engaging relationship to hold the wings temporarily in the pressure engagement position.

2. An integral corner shelf support bracket according to claim 1 for use with a shelf member having a generally planar top wall and a front wall extending downward from a front edge thereof, wherein each wing includes:

(a) a side portion adapted to be positioned against and parallel to one of the first and second walls;

(b) a top portion extending inward from a top edge of the side portion generally perpendicular thereto for supporting the top wall of the shelf member; and (c) a fillet portion extending inward from a front edge of the side portion and downward from the front edge of the top portion for covering space between the side portion and the front wall of the shelf member.

3. An integral corner shelf support bracket according to claim 2 wherein at least a section of an outside surface of the side portion of each wing has an abrasive texture to increase the friction and enhance the pressure engagement between the wings and the first and second walls.

4. An integral corner shelf support bracket according to claim 3 wherein the top wall of the shelf member has a back opening and the hinge portion of the support bracket has an upwardly extending pin adapted to be aligned with and inserted into the back opening to hold a shelf member in place on the support bracket.

5. An integral corner shelf support bracket according to claim 4 wherein said plastic is resilient.

6. A combination of an integrally molded plastic shelf support bracket and separate bracket lock, the shelf support bracket consisting essentially of:

(a) a left wing having at least one means for connection to a first wall;

(b) a right wing having at least one means for connection to a second wall;

(c) a hinge portion integrally connecting the left and right wings together and permitting relative flexing movement of the wings in a plane extending between them;

(d) a left cross brace member (i) integrally connected to the left wing and extending therefrom toward the right wing and flexibly moveable in the plane extending between the wings, and (ii) including a first serrated section having a plurality of triangular shaped teeth; and (e) a right cross brace member (i) integrally connected to the right wing and extending therefrom toward the left wing and also flexibly moveable in the plane extending between the wings, and (ii) including a second serrated section having a plurality of triangular shaped teeth overlapping the first serrated section whereby the cross brace members may be flexed in said plane to force the left and right wings into pressure engagement with the first and second walls and the serrated sections may be pressed together in cooperative engaging relationship to hold the wings temporarily in the pressure engagement position; and the bracket lock comprising means to connect the cross brace members permanently together with the serrated sections in the cooperative engaging relationship to maintain the wings in the pressure engagement with the first and second walls.

7. A combination according to claim 6 wherein the bracket lock includes a cap having a slot for receiving the left and right cross brace members and to hold the serrated sections thereof together.

8. A combination according to claim 7 wherein:

(a) the slot extends upward from a bottom of the cap; and (b) the perpendicular distance from a top of the slot to a top of the cap is chosen so that when the cap is mounted on the cross brace members and the top of the slot is brought into contact with tops of the cross brace members, the top of the cap is substantially coplanar with the top surfaces of the left and right wings.

9. A combination according to claim 8 wherein the height of the cap is chosen so that when the cap is mounted on the cross brace members and the top of the slot is brought into contact with tops of the cross brace members, the bottom of the cap is substantially coplanar with bottom surfaces of the left and right wings.

10. A combination of an integrally molded plastic shelf support bracket, separate bracket lock, and separate outside sleeve member, the shelf support bracket consisting essentially of:

(a) a left wing having at least one means for connection to a first wall;

(b) a right wing having at least one means for connection to a second wall;

(c) a hinge portion integrally connecting the left and right wings together and permitting relative flexing movement of the wings in a plane extending between them;

(d) a left cross brace member (i) integrally connected to the left wing and extending therefrom toward the right wing and flexibly moveable in the plane extending between the wings, and (ii) including a first serrated section having a plurality of triangular shaped teeth; and (e) a right cross brace member (i) integrally connected to the right wing and extending therefrom toward the left wing and also flexibly moveable in the plane extending between the wings, and (ii) including a second serrated section having a plurality of triangular shaped teeth overlapping the first serrated section whereby the cross brace members may be flexed in said plane to force the left and right wings into pressure engagement with the first and second walls and the serrated sections may be pressed together in cooperative engaging relationship to hold the wings temporarily in the pressure engagement position; and the bracket lock comprising means to connect the cross brace members permanently together with the serrated sections in the cooperative engaging relationship to maintain the wings permanently in the pressure engagement position with the first and second walls; and the sleeve member is adapted to substantially enclose the space bounded by the left and right wings and by an imaginary perimeter bridging across front ends of the wings, and includes (i) a top wall shaped to rest on and to extend substantially over the space bounded by the left and right wings and by the imaginary perimeter, (ii) a bottom wall parallel to the top wall and shaped to extend substantially completely beneath the space bounded by the left and right wings and the imaginary perimeter, and (iii) a front wall extending between and integrally connecting together the top and bottom walls and laterally extending substantially completely between left and right sides thereof.

11. A combination according to claim 10 wherein the top and bottom walls are spaced apart a distance so that when the sleeve member is mounted on the support bracket, the top wall engages and rests directly on the left and right wings thereof, and the bottom wall is closely adjacent to the bottoms of the wings of the support bracket.

12. A combination according to claim 11 wherein:

(a) the bracket lock includes a cap having a slot extending upward from the bottom of the cap for receiving the left and right cross brace members and to hold the serrated sections thereof together; and (b) the distance from a top of the slot to a top of the cap is chosen so that when the cap is mounted on the cross brace members and the top of the slot is brought into contact with tops of the cross brace members and the sleeve member is mounted on the support bracket, the top of the cap engages and supports the top wall of the sleeve member.

13. A combination according to claim 12 wherein the height of the cap is chosen so that when the cap is mounted on the cross brace members and the top of the slot is brought into contact with tops of the cross brace members, and the outside sleeve member is mounted on the support bracket, the bottom of the cap engages the bottom wall of the outside sleeve member to use that bottom wall to help support loads placed on the top wall of the sleeve member.

* * * * *